US005409198A

United States Patent [19]

Roick

[11] Patent Number: 5,409,198

[45] Date of Patent: Apr. 25, 1995

[54] SPRING ANCHOR CLIP FOR FLANGED FURNITURE FRAMES

[76] Inventor: Reinhard M. Roick, P.O. Box 734, R.R. #1, Burks Falls, Ontario, Canada, P0A 1C0

[21] Appl. No.: 283,596

[22] Filed: Aug. 1, 1994

[30] Foreign Application Priority Data

Apr. 6, 1994 [DE] Germany ..... 9405703 U

[51] Int. Cl.[6] ..... F16F 3/02; A44B 13/02

[52] U.S. Cl. ..... 267/107; 24/336; 24/563; 297/452.52; 5/259.1

[58] Field of Search ..... 267/103, 107, 110, 182; 248/215, 301, 303, 304; 24/336, 543, 545, 563; 297/452.52, 452.63; 5/259.1, 263, 264.1

[56] References Cited

U.S. PATENT DOCUMENTS

| | | | |
|---|---|---|---|
| 2,213,234 | 8/1938 | Tinnerman | 24/336 |
| 4,153,959 | 5/1979 | Omley | 5/259.1 |
| 4,815,717 | 3/1989 | Crosby | 297/452.52 |

FOREIGN PATENT DOCUMENTS

| | | | |
|---|---|---|---|
| 0799878 | 8/1958 | United Kingdom | 24/336 |

*Primary Examiner*—Robert J. Oberleitner
*Assistant Examiner*—Chris Schwartz
*Attorney, Agent, or Firm*—Riches, McKenzie & Herbert

[57] ABSTRACT

A furniture frame is disclosed in which the ends of furniture springs are coupled to two spaced opposing metal frame members by plastic clips which have been secured in a friction-fit-manner to flanges formed in each frame member. The flange of each frame member extending in a direction away from the opposing frame member to an open end. Each clip having a generally S-shaped profile and including a frame engaging hook portion which is separated from a spring engaging hook portion by a central portion of the clip. The frame engaging hook portion and central portion defining a slot opening in a first direction, and which is sized to receive therein in a friction-fit the open end of a flange. The spring retaining hook portion and central portion defining a second slot opening in a direction opposite to the first direction, and which is sized to receive and retain therein one end of the spring.

20 Claims, 2 Drawing Sheets

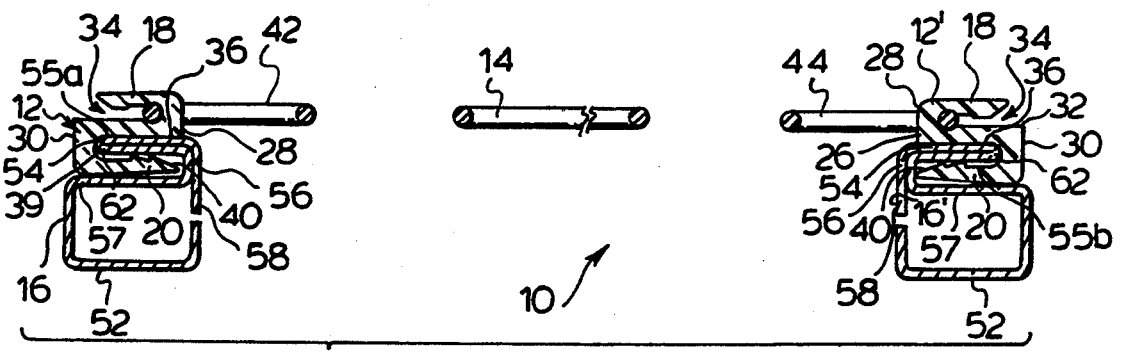
FIG. 4.
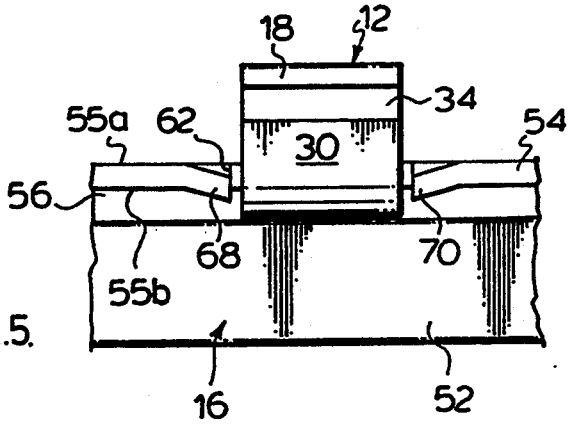
FIG. 5.
FIG. 6.
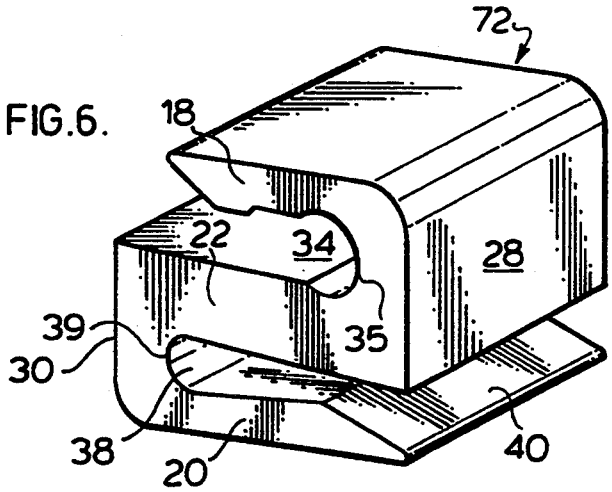

SPRING ANCHOR CLIP FOR FLANGED FURNITURE FRAMES

SCOPE OF THE INVENTION

This invention relates to a furniture frame and, more particularly, to a furniture frame in which the ends of furniture springs are coupled to frame members via anchor clips which are secured to the frame members in a friction-fit-manner.

BACKGROUND OF THE INVENTION

In the construction of conventional seating and reclining furniture, no-sag, coil or other types of furniture springs used for cushion support are typically secured to wooden frame members by plastic clips which have been nailed, stapled or otherwise mechanically fastened to the frame members. Where metal braces or frame members have been employed, heretofore the furniture springs were coupled thereto by either clips attached to the frame members by T-pins, or alternately, by S-shaped connecting pins inserted through holes formed through the frame members.

A major difficulty in the construction of conventional furniture frames exists in that increased equipment costs as well as time and labour are necessary to mechanically affix conventional clips to the frame members.

Additionally, in the case of metal frame members, the use of T-Pins or conventional S-clips necessitates the formation of holes through metal frame members, which may damage protective coatings applied to the frame members increasing the likelihood that they may corrode prematurely.

A further disadvantage with conventional furniture frames exists in that load forces applied to furniture springs frequently results in direct metal-on-metal contact between either the spring and the frame member, or the clip and either the spring or the frame member. Over time the metal-on-metal contact results in an annoying squeaking noise as one metal part moves against another.

SUMMARY OF THE INVENTION

Accordingly, it is an object of the present invention to at least partially overcome the disadvantages of the prior art by providing a furniture frame assembly wherein the ends of furniture springs are coupled to frame members by clips which are secured to the frame members in a friction-fit-manner.

A further object is to provide a furniture frame assembly wherein S-shaped clips are used to secure the furniture springs to metal frame members and which can be attached to the frame members quickly and easily by hand, without the use of specialized tools, pins, staples or other mechanical fasteners.

Another object of the invention is to provide a furniture frame which may be assembled with minimized damage to protective coatings which have been applied to metal frame members and springs and without the necessity of forming holes through the frame members.

Another object is to provide a furniture frame wherein the furniture springs are coupled to the frame members by clips which minimize direct metal-on-metal contact.

In furtherance of these objects, the invention provides a furniture frame which includes a brace or frame member, furniture springs and S-shaped anchor clips for use in securing the springs to the frame member. The frame member including a flange extending to an open end in a direction generally against the direction of load forces applied by the spring. Each S-shaped anchor clip is characterized by two hooked portions separated by a central portion and which define two oppositely facing slots. A first slot is sized to receive and retain therein in a friction-fit-manner the open end of the flange, with the other second slot sized to receive and retain therein an end of the spring.

The anchor clip is secured to the frame member with the first slot positioned over the open end of the flange and the second slot open against the direction of load of the spring. In this configuration, the forces applied by end of the spring on the second slot urge the clip in a direction wherein first slot is moved further onto the open end of the flange.

The springs used with the present invention include no-sag springs, coil springs or any other spring types used with furniture. The springs are preferably provided at each end with a rigid hook, a loop, or other catch device which assists in the retention of the ends of the spring in the respective second slots of the clip members.

Preferably at least two parallel spaced frame members are provided, with aligned pairs of anchor clips used to secure the ends of a number of springs in position spanning between frame members. Each frame member including at least one flange extending to an open end in a direction generally against the direction of load forces applied by the springs, and away from the opposing frame member.

The hooked portion which defines the first slot preferably is resiliently deformable from an unbiased position to a biased position. In the unbiased position, the hooked portion angles towards the central portion so that its end is spaced therefrom a distance which is less than the thickness of the open end of the flange. When the flange is inserted into the first slot, it thereby engages the hooked portion to move it from the unbiased to the biased position. In this configuration, when the flange is inserted in the first slot, the resilient tendency of the hooked portion to return to its unbiased position maintains the hooked portion in constant contact with the flange, enhancing the friction-fit of the anchor clip on the flange.

The present invention advantageously may be used to minimize metal-on-metal contact between steel springs and steel frame members. By forming the clip members preferably from an integral piece of plastic, the central portion of the anchor clip advantageously maintains a continuous spacing between the end of the spring and frame.

Accordingly, in one aspect the present invention resides in a furniture frame with spaced first and second frame members, elongate spring means having a first end and a second end and catch means at said first end, anchor means for securing the first end of the spring to the first frame member, the spring means spanning between the frame members with the first end connected via the anchor means to the first frame member and the second end connected to the second frame member, the first frame member including a thin flange member having generally planar surfaces extending from the first frame member to a distal end of the flange member in a direction away from the second frame member, the anchor means comprising a generally S-shaped clip member including a spring retaining hook portion, a frame engaging hook portion, and a central portion between the spring retaining hook portion and the frame engaging hook portion, the central portion having a forward end and a rearward end, the spring retaining hook portion extending from the central portion towards the rearward end and away from the second frame member so as to define a first slot between the central portion and the spring retaining hook portion open towards the rearward end, the first slot receiving and retaining therein the spring catch means, the frame engaging hook portion extending from the central portion towards the forward end and towards the second frame member so as to define a second slot between the central portion and the frame engaging hook portion open towards the forward end, the second slot receiving therein in a friction-fit-manner the open distal end of the flange member, the first end of the spring means secured to the first frame member with the spring catch means received in the first slot and the distal end of the flange member received in the second slot, wherein the spring means forwardly urges the second slot onto the open distal end of the flange.

BRIEF DESCRIPTION OF THE DRAWINGS

Further objects and advantages of the invention will appear from the following description with the accompanying drawings in which:

FIG. 4 is a cross-sectional view of the furniture frame of FIG. 3 taken along lines 4—4';

FIG. 5 is a perspective rear view of the anchor clip and frame member shown in FIG. 3 prior to attachment of the furniture spring; and FIG. 6 is a perspective view of an anchor clip in accordance with a second embodiment of the invention.

DETAILED DESCRIPTION OF THE DRAWINGS

Figure 3:
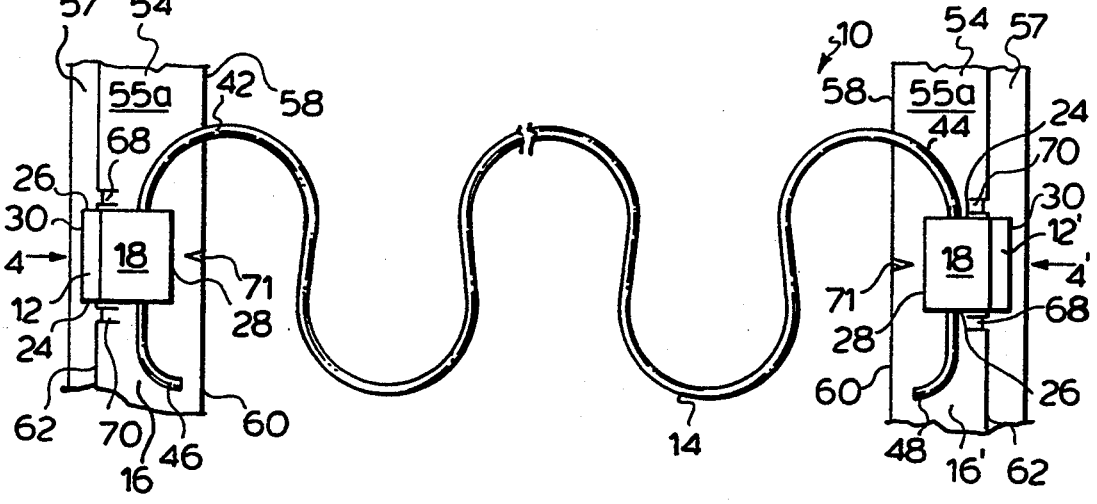
FIG. 3 is a partial perspective top view of a furniture frame in accordance with the present invention.

Reference is first made to FIGS. 3 and 4 which show a furniture frame assembly generally indicated 10. The frame assembly 10 comprises three principal components, anchor clips 12,12', a no-sag spring 14, and frame members 16,16'. As will be described later, the anchor clips 12,12' are used to secure the spring 14 in position spanning the frame members 16,16' without the need of mechanical fasteners and the like.

Figure 1:
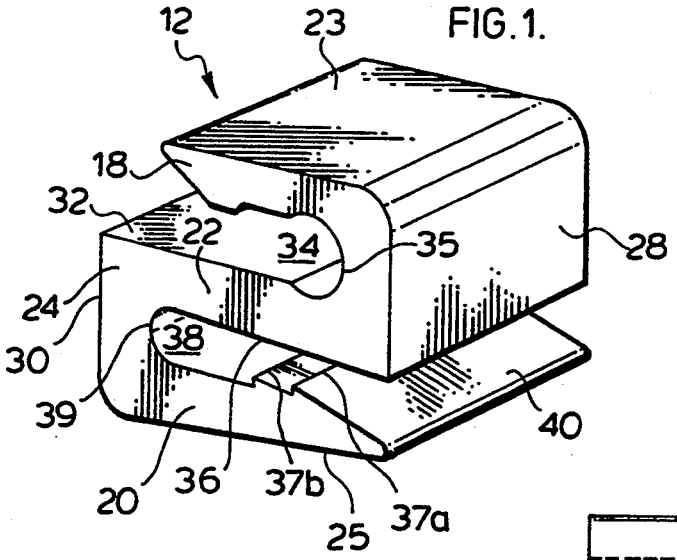
FIG. 1 is a perspective view of a preferred anchor clip for use with the present invention.
Figure 2:
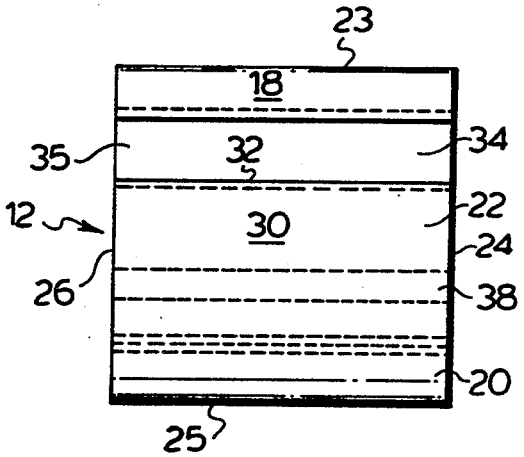
FIG. 2 is a schematic rear view of the clip of FIG. 1.

FIGS. 1 and 2 show best a single preferred anchor clip 12 for use with the present invention which is integrally formed from a piece of plastic. The clip 12 is block-like having parallel sides 24,26, and top and bottom surfaces 23,25, as well as generally parallel forward and rearward ends 28,30 extending in a lateral direction perpendicular to the sides 24,26. In profile the clip 12 is generally S-shaped and in the orientation shown, includes an upper hook 18 for engaging part of the spring 14, which is separated from a lower hook 20 for engaging a frame member 16 by a central portion 22. The central portion 22 provided with generally flat upper and lower surfaces 32,36 and is of a suffient width to provide a bearing surface, which when engaged in an abutting coplanar relationship substantially prevents pivotal movement of the clip 12.

The spring engaging hook 18 extends from a forwardmost part of the upper surface 32 of the central portion 22 towards the rearward end 30 to define an upper slot 34 between the upper surface 32 and the spring retaining hook 18 open to the rearward end 30. The upper slot 34 extending across the clip 12 into both side 24,26 and forwardly to an enlarged upper bight 35.

The frame engaging hook 20 extends from a rearwardmost part of the lower surface 36 towards the forward end 28 to define a lower slot 38 between the lower surface 36 and frame engaging hook 20 open to the forward end 28. The lower slot 38 extends across the clip 12 into both sides 24,26 and rearwardly to a lower bight 39 formed by the hook 20.

Forward of the bight 39, the frame engaging hook 20 tapers inwardly in thickness and angles towards the central portion 22 in the direction of the forward end 28. The hook 20 is resiliently deformable from the unbiased position shown in FIG. 1, wherein the hook 20 angles towards the central portion 22, to a biased position wherein the hook 20 is moved away from the central portion 22. As will be described later, the resiliently deformable frame engaging hook 20 advantageously assists in maintaining the clip 12 in a position secured to the frame member 16. With the clip preferably formed as by injection molding from a suitable plastic, the clip may inherently be provided with desired resiliency having regard to the shape of the clip and the nature of the plastic material used.

A forwardmost end of the hook 20 is provided with a camming surface 40 which extends from the bottom surface 25 angularly rearward towards the central portion 22. The camming surface 40 assists in moving the frame engaging hook 20 towards the biased position to facilitate positioning of the clip 12 on the frame member 16.

FIG. 1 shows best the frame engaging hook 20 as further having with a series of ribs 37*a*,37*b*, projecting from the hook 20 into the slot 38 towards the central portion 38. The ribs 37*a*,37*b* extending laterally across the clip 12 from side 24 to side 26.

FIGS. 3 and 4 show part of a furniture frame 10 wherein a metal no-sag spring 14 is secured in tension spanning two elongate and parallel metal furniture frame members 16,16' by a pair of anchor clips 10,10'. While a single spring 14 has been shown for clarity, it is to be appreciated that in use, the frame 10 would typically incorporate a number of springs, arranged and held a generally parallel relationship by a corresponding number of pairs of anchor clips.

FIG. 3 shows the spring 14 having a length which when untensioned is slightly less than the innermost distance between the frame members 16,16'. A first spring end 42 is coupled to frame member 16, via clip 12, with the second other spring end 44 coupled to frame member 16' via clip 12'. The spring 14 includes as a catch device at each end 42,44 a rigid hook 46,48. The hooks 46,48 are sized for insertion into the upper slot 34 of each anchor clip 10,10', and have a thickness to abuttingly engage the upper bight 35 of each respective clip 12,12'. The engagement of the hooks 46,48 with the respective bights 35 retaining ends 42,44 in the clips 12,12' against load forces applied to the spring 14.

FIGS. 4 and 5 show best the elongate frame members 16,16' for use in the present invention. Frame member 16 is of an identical construction to frame member 16' with frame member 16' positioned in a mirror configuration to frame member 16 and like reference numerals identifying like features. Each frame member 16,16' is integrally formed from a single sheet of steel, and includes an elongate hollow frame support 52, a flange 54 and a connecting web 56. The frame support 52 has a generally rectangular cross-section and includes a generally vertically oriented forward side 58 positioned closest the opposing frame support, and a generally horizontal upper surface 57. The flange 54 extends in a rearward direction away from the opposing frame member from a forward edge 60 to an open distal end 62. The flange 54 is elongated along the length of the frame support 56 in a generally horizontal orientation spaced above the upper surface 57, and includes a planar upper flange surface 55*a* and a planar lower flange surface 55*b*. The connecting web 56 projects generally vertically from the forward side 58 of the support 52 to join with the forward flange edge 60. The flange 54 has a thickness approximately equal to the distance between the frame engaging hook 20 and the central portion 22 adjacent the lower bight 39, so as to fit snuggly within the lower slot 38.

FIG. 5 shows best a pair of stop shoulders 68,70 which are formed in the flange 54 by crimping spaced locations of the open distal end 62 of the flange 54. The distance separating stop shoulder 68 from stop shoulder 70 being selected slightly larger than the distance between clip side 24 and clip side 26.

The frame members 16,16' are fixed in parallel relationship as for example by cross-braces (not shown) joining the ends of each frame member. The anchor clips 12,12' are manually secured to respective frame members 16,16' at opposing spaced locations. To position each clip 12,12' the clip is held with the lower slot 38 open towards the distal end 62 and the upper slot 34 opening away from the opposing frame member and the spring retaining hook 18 positioned above the flange 54. The clips 12 are pushed onto the distal end 62 of the respective flange 54 at a position between each pair of stop shoulders 68,70, with the distal end 62 of the flange 54 received in the slot 38. As clip 12 is slid so that the distal end 62 moves inwardly into the slot 38, the end 62 contacts and moves along the angled slope of the camming surface 40, thereby assisting in moving the frame engaging hook 20 to the biased position shown in FIG. 4. The movement of hook 20 to the biased position facilitating movement of the distal end 62 into the slot 38. The clip 12 is slid in a forward direction towards the opposing frame member until the distal end 62 engages the lower bight 39 to limit further forward movement of the clip 12.

With the clip 12 positioned on the flange 54, the flat lower surface 36 of the central portion 22 is positioned resting flat upon the planar upper flange surface 55*a*, and the frame engaging hook 14 engages the lower flange surface 55*b*. The width of lower surface 36 and extent of the slot 38 sufficiently sized so that the part of the lower surface 36 in contact with the flange surface 55*a* acts as a bearing surface to substantially eliminate pivotal movement of the clip 12 relative to the flange 54. In this regard, the slot 38 preferably is formed having a length of at least 1 cm. and the lower surface 36 preferably has a width of at least 1 cm., and more preferably 1.5 to 2.5 cm. As the relative sizing of the lower slot 38 and flange 54 are configured such that the flange 54 is snuggly received in the lower slot 38, the clip 16 is retained on the flange 54 against removal by the friction-fit of the central portion 22 and hook 20 with the flange 54. The friction-fit of the clip 12 on the flange 54 is further enhanced by both the engagement of rib members 37*a*,37*b* with the lower flange surface 55*b* and the resilient tendency of the frame engaging hook 20 to return to its unbiased position. Preferably the configuration and resiliency of hook 20 is selected such that both rib members 37*a* and 37*b* will bear on the lower flange surface 55*b*.

With the clip 12 secured to the flange 54, the engagement of the stop shoulders 68,70 with the sides 24,26 the clip 12 prevents lateral sliding movement of the clip 12 along the respective frame member, thereby ensuring that the spring coupled thereto is maintained at the desired spacing and location. Although a pair of stop shoulders are advantageously used, other means of both limiting movement of the clips and assisting in the correct positioning of the anchor clips on the flange may also be used. To assist positioning of the clips 12 visual indicia 71 embossed on the flange or elsewhere may be provided.

With the clips 12,12' attached to each frame member 16,16' the spring 14 is coupled to the clips 12,12'. The spring 14 is extended to move the hook 46,48 at each end 42,44 of the spring 14 rearwardly past a rearward most end of each upper hook 18, and the hooks 46,48 are moved into the upper slot 34 of each clip 12,12' respectively. On insertion of the hooks 46,48 the tendency of the spring 34 to collapse moves the hooks 46,48 forwardly in each upper slot 34 to engage and maintain engagement with the upper bight 35 of the respective clips 12,12'. With the spring 14 in place spanning the frame members 16,16' cushions or the desired padding may next be applied to complete the furniture piece.

Providing a spring 14 having an untensioned length which is slightly less than the distance between the frame members 16,16' is advantageous in that even with no load applied to the frame 10, the spring 14 is kept under slight tension maintaining its position coupled to the clips 12,12'.

As is to be appreciated, in use of the frame 10 load forces applied on the spring 14 will act to move the spring ends 42,44 forwardly in the upper slots 34. As the spring ends 42,44 move forward, they engage the upper bight 35 of the associated clip 12,12' and transmit the load forces through the clips 12,12' to urge the lower slots 38 further onto each associated open distal end 62. Under load forces, the abutting coplanar relationship between the flat lower surface 36 and the planar upper flange surface 55*a* substantially eliminates pivoting movement of the clips 12,12' relative to the frame members 16,16'. The abutment of the central portion 22 against the upper flange surface 55*a* further transmits downward forces on the clip 12, which may otherwise cause the clips 12,12' to break, directly to the metal frame members 16,16'. The S-shape of the clip 12 having a plastic bight 35 and central portion 22 advantageously acts as a spacer between the spring ends 42,44 and flange 54, thereby eliminating direct metal-on-metal contact.

Although it is preferred that the clips 12 be sized for positioning on the flanges 54 directly above the support members 52 so that downward forces are transmitted directly to the strongest part of the frame 10, the clips 12 may also be configured such that the spring retaining hook portion extends either below the flange or at a position moved away from above the frame support 52.

In the preferred embodiment shown, the upper hook 18 extends only part-way to the clip rearward end 30 to minimize the distance the no-sag spring 14 must be extended so that the hooks 46,48 may be inserted into the respective slot 34. It is to be appreciated that by the use of other types of springs having a lesser spring tension, a hook 18 of increased length may be used.

While the preferred embodiment shows an anchor clip having a saw tooth profile formed by a series of ribs 37*a*,37*b*, it is to be appreciated that such ribs are not essential. FIG. 6 shows a second embodiment of an anchor clip 72 wherein identical reference numerals are used to identify like features. In the anchor clip 72 of FIG. 6, the frame engaging hook 20 is formed as a substantially flat hook having a camming surface 40 at its forwardmost end. The assembly of a furniture frame incorporating clip 72 is essentially identical to that of clip 12 shown in FIGS. 1 to 5.

While the preferred embodiment discloses a preferred frame member 16 as having a hollow frame support 52, flange 54 and web 56, it is to be appreciated that other configurations of frame members and/or frame supports may also be used and will now become apparent.

Although the disclosure describes and illustrates a preferred embodiment of the invention, it is to be understood that the invention is not limited to this particular embodiment. Many variations and modifications will now occur to those skilled in this art. For a definition of the invention, reference is made to the appended claims.

I claim:

1. In combination a furniture frame with spaced first and second frame members, elongate spring means having a first end and a second end and catch means at said first end, anchor means for securing the first end of the spring means to the first frame member, the spring means spanning between the frame members with the first end connected via the anchor means to the first frame member and the second end connected to the second frame member, the first frame member including a thin flange member having generally planar surfaces extending from the first frame member to a distal end of the flange member in a direction away from the second frame member, the anchor means comprising a generally S-shaped clip member including a spring retaining hook portion, a frame engaging hook portion, and a central portion between the spring retaining hook portion and the frame engaging hook portion, the central portion having a forward end and a rearward end, the spring retaining hook portion extending from the central portion towards the rearward end and away from the second frame member so as to define a first slot between the central portion and the spring retaining hook portion open towards the rearward end, the first slot receiving and retaining therein the spring catch means, the frame engaging hook portion extending from the central portion towards the forward end and towards the second frame member so as to define a second slot between the central portion and the frame engaging hook portion open towards the forward end, the second slot receiving therein in a friction-fit-manner the open distal end of the flange member, the first end of the spring means secured to the first frame member with the spring catch means received in the first slot and the distal end of the flange member received in the second slot, wherein the spring means forwardly urges the second slot onto the open distal end of the flange.

2. The combination as claimed in claim 1 wherein the central portion of the clip member has a flat surface opposed to the frame engaging hook portion such that with the distal end of the flange member received in the second slot, the flat surface abuts in coplanar relation one of the planar surfaces of the flange member.

3. The combination as claimed in claim 2 wherein said flange member is provided in a generally horizontal orientation and said planar surfaces are upper and lower flange surfaces, the distal end of the flange member is received in the second slot with the flat surface abutting the upper flange surface and the frame engaging hook portion engaging the lower flange surface.

4. The combination as claimed in claim 3 wherein the frame engaging hook portion includes a rib member extending into the second slot to engage said lower flange surface to restrict removal of the distal end from the second slot.

5. The combination as claimed in claim 1 wherein the frame engaging hook portion extends substantially to the forward end of the central portion.

6. The combination as claimed in claim 1 wherein the frame engaging hook portion is resiliently deformable away from the central portion from an unbiased position, wherein the frame engaging hook portion angles towards the forward end of the central portion, to a biased position away from the central portion, the flange member having a thickness to urge the frame engaging hook portion away from the unbiased position when the distal end is inserted into the second slot.

7. The combination as claimed in claim 6 wherein a forwardmost end of the frame engaging hook portion includes a camming surface extending rearwardly and towards the central portion to engage the distal end of the flange member on insertion of the distal end into the second slot and assist movement of the hook engaging portion away from the unbiased position.

8. The combination as claimed in claim 1 wherein the central portion of the clip member includes an upper surface and a flat lower surface, said spring retaining hook portion extending from the upper surface, and said frame engaging hook portion extending from the lower surface, said flange member provided in a generally horizontal orientation with said generally planar surfaces comprising an upper and a lower flange surface, the frame engaging hook portion engaging the lower flange surface and the flat lower surface abutting in coplanar relation with the upper flange surface to prevent pivoting movement of the clip member relative to the flange member.

9. The combination as claimed in claim 8 wherein the central portion, the spring retaining hook portion and the frame engaging hook portion are integrally formed.

10. The combination as claimed in claim 9 wherein the clip member is formed entirely from plastic.

11. The combination as claimed in claim 10 wherein the frame engaging hook portion is resiliently deformable away from the central portion from an unbiased position, wherein the frame engaging hook portion angles towards the forward end of the central portion, to a biased position away from the central portion, the flange member having a thickness to urge the frame engaging hook portion away from the unbiased position when the distal end is inserted into the second slot.

12. The combination as claimed in claim 8 wherein the first frame member includes guide means for positioning of the clip member on the frame member.

13. The combination as claimed in claim 12 wherein the guide means comprises visual indicia on the frame.

14. The combination as claimed in claim 12 wherein said clip member further includes generally parallel spaced sides, both of the first and second slots extending laterally through the clip member from one side to the other, the guide means comprising shoulder means on the flange member spaced on both sides of the clip member to engage each of said sides and restrict lateral sliding movement of the clip member along the flange member.

15. The combination as claimed in claim 8 wherein the flange member includes a forward end remote from the distal end, the first frame member further comprising an elongate support member and web means, joining the forward end of the flange member to the support member.

16. The combination as claimed in claim 15 wherein the flange member, the web means and the support member are integrally formed.

17. The combination as claimed in claim 15 wherein the support member comprises a tubular member.

18. The combination as claimed in claim 1 wherein the first frame member includes guide means for positioning of the clip member on the frame member.

19. The combination as claimed in claim 18 wherein said clip member further includes generally parallel spaced sides, both of the first and second slots extending laterally through the clip member from one side to the other, the guide means comprising shoulder means on the flange member spaced on both sides of the clip member to engage each of said sides and restrict lateral sliding movement of the clip member along the flange member.

20. The combination as claimed in claim 1 wherein the flange member includes a forward end remote from the distal end, the first frame member formed from metal and further comprising an elongate support member and web means, joining the forward end of the flange member to the support member, with the flange member, web means and support member integrally formed.

* * * * *